United States Patent [19]

Winkler

[11] Patent Number: 4,485,631

[45] Date of Patent: Dec. 4, 1984

[54] METHOD AND APPARATUS FOR RAPIDLY REGENERATING A SELF-CONTAINED CRYOPUMP

[75] Inventor: Otto Winkler, Balzers, Liechtenstein

[73] Assignee: Balzers Aktiengesellschaft, Liechtenstein

[21] Appl. No.: 531,690

[22] Filed: Sep. 13, 1983

[30] Foreign Application Priority Data

Sep. 17, 1982 [CH] Switzerland ..... 5501/82

[51] Int. Cl.[3] ..... B01D 8/00

[52] U.S. Cl. ..... 62/55.5; 55/269; 62/6; 62/268; 417/901

[58] Field of Search ..... 62/6, 55.5, 514 R, 100, 62/268; 417/901; 55/269

[56] References Cited

U.S. PATENT DOCUMENTS 3,218,815 11/1965 Chellis et al. ..... 62/6
3,338,063 8/1967 Hogan et al. ..... 62/55.5
3,585,807 6/1971 Hengevoss et al. ..... 62/55.5
3,797,264 3/1974 Thibault et al. ..... 62/55.5
4,055,960 11/1977 St. Clair ..... 62/6
4,235,078 11/1980 Morbidi ..... 62/6

FOREIGN PATENT DOCUMENTS 547549 5/1977 U.S.S.R. ..... 62/55.5

*Primary Examiner*—Ronald C. Capossela
*Attorney, Agent, or Firm*—McGlew and Tuttle

[57] ABSTRACT

To reduce the time for regenerating self-contained cryopumps a direct connection is provided during the defrosting operation between the associated expansion space and the high-pressure gas source of the cryogenerator, to heat up the low-temperature condensation surface, while the cryogenerator continues to operate. The application is particularly to multi-stage self-contained cryopumps.

6 Claims, 3 Drawing Figures

METHOD AND APPARATUS FOR RAPIDLY REGENERATING A SELF-CONTAINED CRYOPUMP

FIELD AND BACKGROUND OF THE INVENTION

This invention relates in general to cryopumps and in particular to a new and useful method and apparatus for rapidly regenerating a self-contained cryopump.

The invention relates to cryopumps serving the purpose of producing medium and high vacuum in apparatus used for vacuum processes on an industrial scale. Recently, for some years, cryopumps are employed for this purpose at a growing rate, since they not only have a very high specific suction capacity, but also are capable of producing a "clean" vacuum, namely free from hydrocarbons and having low final pressures. Since, in contradistinction to delivery-type vacuum pumps, the evacuated gases are stored in the cryopump, a regeneration is needed from time to time. The invention deals specifically with this problem.

Cryopumps are employed, for example, in apparatus for producing thin layers in a cathode sputtering process, operating with a relatively large argon thruput and within the region of $10^{-3}$ to $10^{-2}$ millibar. To obtain in program controlled units reproducible results and layers of good quality, the partial pressure of the other residual gases, particularly of hydrogen, must be kept as low as possible in the coating chamber.

A satisfactory capacity for exhausting hydrogen, however, is important also in other vacuum processes, and in the vapor deposition under high vacuum, for example where metals are evaporated from crucibles containing evaporative substances or through wall reactions in the evaporation chamber, considerable hydrogen amounts may be set free. But, just for hydrogen, and also for helium, the storage capacity of conventional cryopumps is low.

To operate so called self-contained cryopumps, i.e. such working without a supply of a coolant from the outside, mostly cryogenerators are now used. The operation of which is based on either the Stirling cycle or the Gifford-McMahon cycle. To produce the low temperatures needed for condensing the permanent gases, frequently two series-connected cryogenerator stages are provided. On the cryocondensation surfaces connected to the first stage, which will be termed high-temperature stage (HT stage) in the following, the gases easier to condense, such as water vapor, $CO_2$, and higher hydrocarbons, undergo condensation. In the HT stage, the temperature mostly ranges from 70 to 120 K. This stage cools at the same time the radiation screen for the second stage which will be termed low-temperature stage (LT stage) in the following. On the condensation surfaces which are connected to this LT stage, gases, such as Ar, $O_2$, and $N_2$ are either frozen out, or, such as $H_2$, He and Ne are fixed by cryosorption to a sorbent, for example activated carbon, In the LT stage, the temperature mostly ranges between 15 and 20 K.

The temperature, establishing on the cryosurfaces of the two stages is determined by the refrigerating capacity available at the respective stage, and by the enthalpy of the exhausted gases and the thermal flux through radiation and heat conduction from the ambience.

The equilibrium pressure of a condensed and sorbed gases, such as hydrogen, is a function of the temperature establishing in the LT stage. Even though at a temperature of 20 K., $H_2$ has an equilibrium pressure of approximately 1 bar, the partial pressure of hydrogen can be lowered below $10^{-6}$ millibar by cryosorption in activated carbon which is glued on the LT cryosurface. However, the amount of hydrogen removable by pumping is limited. It depends on the amount and temperature of the sorbant, and on the amount of gases which are sorbed simultaneously or have been sorbed earlier. After a certain time, the sorbant becomes saturated and the equilibrium pressure of the hydrogen starts rising. Then, it is necessary to regenerate the sorbant by baking it out. Up to the present time, this was possible only upon stopping the operation of the cryogenerator.

To avoid a premature exhaustion of the sorbing capacity and thus heep the surface temperature of the sorbant, which is codeterminative for the equilibrium pressure in dynamic pumping processes, as low as possible, the LT cryosurface areas which are covered by the sorbant must be so disposed that they are protected against irradiation from surfaces having a higher temperature, and that all the gases, except He and $H_2$ are condensed with a high probability prior to arriving at the sorbant.

Even while complying with this precondition, experience has shown, at least in instances where, unlike in cathode sputtering for example, not too large amounts of gases are exhausted, that as a rule, the hydrogen must be removed already at an instant at which the equilibrium pressure of the other gases on the LT cryosurface has not yet exceeded permissible values.

As mentioned, an exception is the use of a cryopump in a cathode sputtering process. There, mostly so large gas amounts must be condensed that finally a regeneration becomes a necessity, because of the temperature gradient building up on the condensate layer, or of the clogging of the intermediate spaces between the condensation surfaces. In both instances, up to the present, the operation of the vacuum apparatus must be stopped for regeneration, which of course enters into operating costs and is to be minimized.

According to prior art methods, to effect a regeneration, the cryopump is separated from the vacuum apparatus by means of a high-vacuum valve, and then stopped. The result is that the cryosurfaces heat up, initially slowly due to thermal irradiation from the ambience, and then faster due to the heat conduction of the gas again evaporating from the condensation surfaces, up to the room temperature. The gases set free are evacuated by the fore-vacuum pump which, besides, is needed for initially evacuating the vacuum apparatus. Condensed water also re-evaporates, yet becomes partly absorbed on the inside surfaces of the cryopump.

The cryogenerator can then be cooled down again by restarting its operation, as soon as a pressure of about 0.1 millibar is reached again in the cryopump. This lowers the partial pressure of water vapor very rapidly to values below $10^{-3}$ millibar. Since the residual gas is composed substantially of water vapor, the thermal conductivity is then small relative to the thermal irradiation, so that the greatest part of the refrigeration capacity is available for cooling down the cryogenerator and the cryosurface.

The time needed for regeneration includes the heating period and the cooling period. The heating period is determined by the enthalpy of the condensed gas amount, and by the mass of the HT and LT stages and the respective cryosurfaces. In processes involving a high thruput of gases, such as in cathode sputtering units, the first named factor may be determining, while the other factors are predominant mostly in apparatus having a small thruput of gases.

The cooling time depends substantially on the cryopump masses to be cooled and on the refrigerating capacity of the two stages in the respective temperature ranges. As a rule, a regenerative cycle of a self-contained cryopump takes several hours.

SUMMARY OF THE INVENTION

The invention is directed to a method of effecting a substantial reduction of the time for regenerating a self-contained cryopump. The inventive method of regenerating a self-contained cryopump by defrosting the low-temperature condensation surfaces thereof which are cooled by a cryogenerator, is characterized in that in accordance with the inventive method a self-contained cryopump is regenerated by defrosting the low temperature condensation surfaces which are cooled by a cryogenerator. The cryogenerator is maintained during the defrosting period and the high pressure gas source used for operating the cryogenerator is connected through a bypass conduit so that it bypasses the regenerative surfaces and it is delivered into the expansion space which cooperates with the low-temperature condensation surfaces.

What is provided is that substantially only the low-temperature condensation surfaces and the walls of the associated expansion spaces are heated by supplying warm gas, without substantially changing the temperatures of the other part of the self-contained cryopump. Already due to this provision, in most instances, the regeneration time is reduced to less than one half. In multi-stage pumps, it is particularly advantageous that the inventive method eliminates the time for cooling the HT stage of the cryogenerator. Since the HT stage remains at the low temperature, there is no chance of contamination or clogging of the sorbant on the cryosurfaces of the LT stage by easier condensing gases such as water vapor of $CO_2$. It suffices to rise the temperature of the LT cryosurfaces by an amount necessary for removing a sorbed and condensed permanent gases. A prerequisite is, of course, that the refrigerating capacity of both the stages is sufficient for handling the heat supply which is then determined mainly by the heat conduction of the evaporating gas.

In accordance with a feature of the invention, the bypass can be shut off by two valves arranged in series, one being provided at the cool end of the bypass and the other at the warm end thereof. The device for regenerating a cryopump includes at least one housing having a cooling head portion with a displacer in the housing adjacent the cooling head portion and defining with said cooling head portion an expansion space therebetween. At least one regenerator is located in the housing adjacent the displacer on a side thereof opposite to the cooling head portion. Flow means are provided for selectively directly a high pressure gas into the housing and for drawing the gas from the housing. In addition, the bypass line is for the gas connected into the housing between the flow means and the expansion space during defrosting for heating up the space and the surfaces of the cooling head portion.

To stop or at least keep small the heat supply to the cooling head through the bypass conduit during the operation of the cryopump, advantageously two shutoff valves in series arrangement are provided in the bypass, of which one is located at the cool end and the other at the warm end of the conduit. This prevents a gas exchange both from the expansion space and from the gas source, which would lead to an undue heat transfer. In addition, care must also be taken to prevent heat from being transferred by conduction. Therefore, a thin-walled tube of a material of small thermal conductivity, such as stainless steel, is to be used as the supply conduit to the valve at the cold end. Further, the dead volume of the conduit from this valve to the expansion space is to be minimized in proportion to the expansion volume, in order to avoid any significant reduction of the refrigerating capacity at the given compressor capacity. On the other hand, the conductance of the conduit should remain sufficiently high to ensure during the defrosting operation that gas flows into and out of the expansion space mainly thorugh this bypass.

Accordingly, it is an object of the invention to provide an improved cryopump construction having a regenerative connection between the high pressure source and the evaporative surfaces.

A further object of the invention is to provide a method of generating a self-contained cryopump by defrosting the low temperature condensation surfaces cooled by a cryogenerator.

A further object of the invention is to provide a device for operation with a cryopump which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
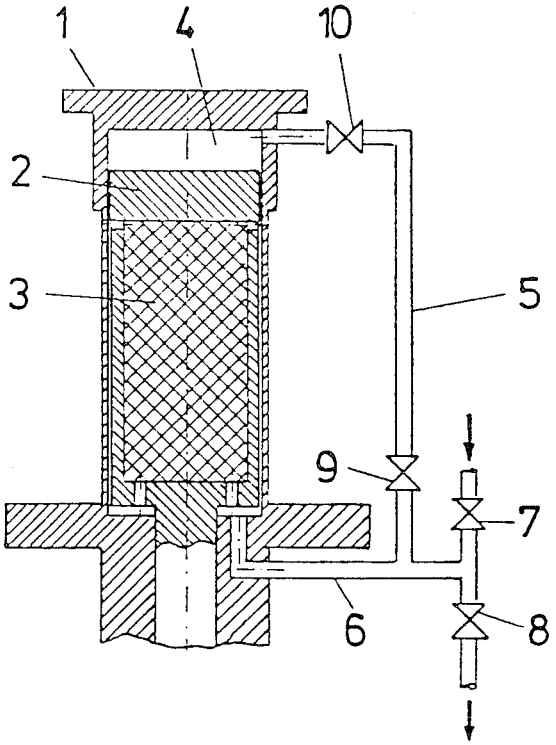
FIG. 1 is a partial transverse sectional view of an arrangement of a cryopump having a bypass in a single stage cryogenerator.

Referring to the drawings in particular the invention embodied therein as shown in FIG. 1 comprises a cryopump including at least one housing having a cooling head portion 1. A displacer 2 is mounted in the housing and the space between the displacer and the cooling head portion defines an expansion space 4. Flow means in the form of a high pressure gas supply line 6 are provided for selectively directing a high pressure gas into the housing when valve 7 is open and for drawing the gas from the housing when valve 8 is opened. In accordance with the invention a bypass line 5 is provided between said flow means 6 and the expansion space 4. A bypass line is connectable to permit some of the gas to move into the bypass line and the expansion space during defrosting for heating up the expansion space surfaces.

FIG. 1 shows a cooling head 1 and a displacer 2 in which the regenerator 3 comprising bronze balls or a bronze lattice is accommodated. An expansion volume or space is shown at 4, and a bypass conduit at 5. At the underside of the displacer 2, a high pressure gas supply line 6 is provided which is connected through a valve 7 to the high pressure side and through a valve 8 to the low pressure side of a gas source. With the valve 7 open, in normal operation, the gas flows through line 6, regenerator 3, and along the walls of cooling head 1 to the expansion space, while upon closing valve 7 and opening valve 8, the gas expands and flows in the opposite direction. The gas is thus cooled.

However, if valves 9 and 10 which are provided in bypass 5 are open, only a part of the gas stream flows through the regenerator, the other part flows through the bypass line 5. This other part, while flowing into expansion space 4, fully retains its heat content. During the following expansion, a cooling does take place, however, only to a heat level which is substantially higher than before. Due to the heat absence of the regenerative effect, the supplied heat amounts to a multiple of the frigorific effect and therefore leads to a gradual heating of cooling head 1.

Figure 2:
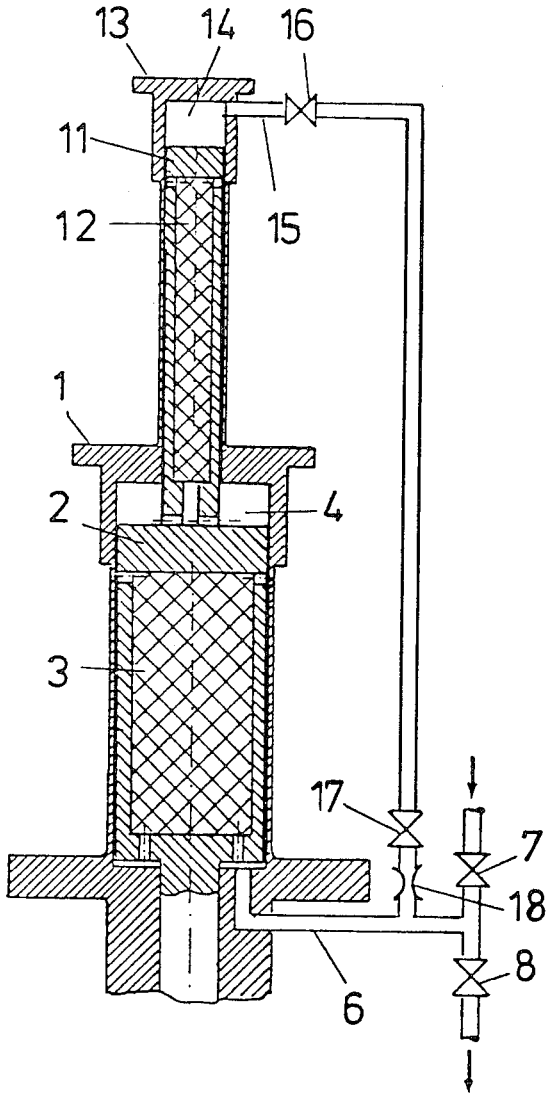
FIG. 2 is a view similar to FIG. 1 of another embodiment of the invention.

FIG. 2 shows an arrangement for a two-stage cryogenerator. Like parts are designated as in FIG. 1. On top of displacer 2, another, smaller displacer 11 is mounted, also accommodating a regenerator 12 comprised of lead balls. The LT cooling head 13 is held at a lower temperature and encloses an expansion space 14 to which, in accordance with the invention, a bypass conduit 15 with valves 16 and 17 is connected.

In normal operation, during the charging phase, the high-pressure gas flows through regenerator 3 into expansion space 4 and therefrom through regenerator 12 into expansion space 14. During the expansion phase, the gas flows in the opposite direction.

Upon opening valves 16 and 17, only the cryosurfaces at the LT stage are defrosted. That is, in the LT stage, the gas now flows during the charging phase in the opposite direction, from expansion space 14 to expansion space 4. The temperature gradient in regenerator 12 is reversed, and acts now as a regenerator which is connected in parallel to regenerator 3. The conditions for the gas flowing from below into expansion space 4 have not substantially changed. The effect of the regeneration is maintained and the temperature and refrigerating capacity of the HT stage will experience only a small change. Only the Lt stage is heating up.

To control the heating or rate of defrosting, two possibilities may be considered:

either the provision of a choke valve 18 in series with valve 17 in the bypass, or a periodical opening and shutting off of the bypass 15.

Figure 3:
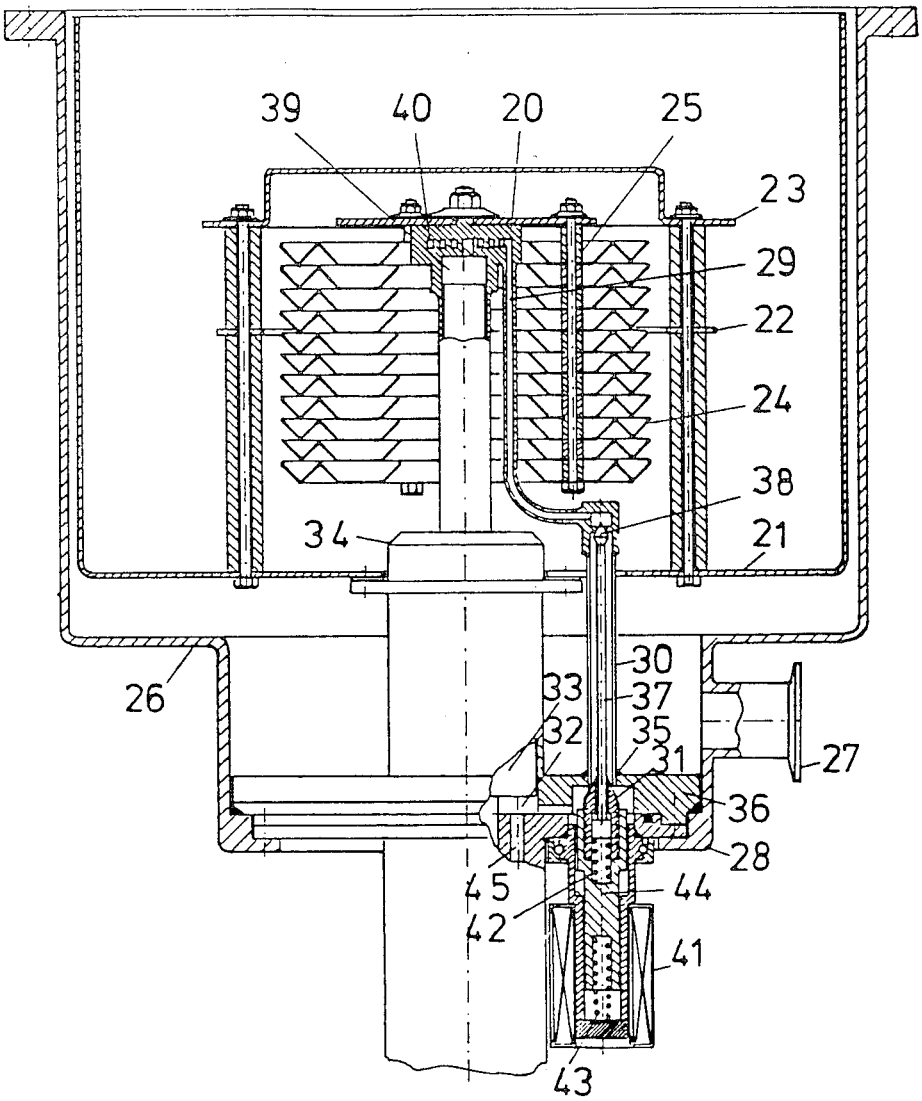
FIG. 3 is a view similar to FIG. 1 of still another embodiment of the invention which comprises the preferred embodiment using a two-stage cryopump.

FIG. 3 shows still another embodiment for applying the invention to a two-stage cryopump. The HT stage of the cryogenerator is shown at 34, the LT stage at 20. The HT stage is connected to the condensation surfaces and radiation screens 21, 22 and 23, and the LT stage is connected to the tray-shaped, thin-walled condensation surfaces 24. These are covered on their sides turned away from the gas entry, with activated carbon. Their shape is advantageous particularly if large amounts of argon are taken off in sputtering apparatus, since then, the recessed surfaces remain protected by the ribs against the argon condensation, and the argon, if liquified, cannot drop therein upon thawing. The thermal connection to the LT stage of the cryogenerator is effected through spacers 25 in the form of pipe lengths of pure silver or pure copper.

The cryopump is accommodated in a cylindrical housing 26 having a fore-vacuum connection 27, and can be inserted into the housing as a finished assembly and vacuum-tightly screwed thereto by a flange 28.

The bypass conduit comprises two sections 29 and 30. Section 30 communicates through a valve 31 with a space 32 at the underside of displacer 33 of the HT stage and then through bore 45 with the high pressure source. This section 30 is made of a thin-walled tube of stainless steel which is soldered at 35 to a flange 36 of the cryogenerator. Within this tubular section, a valve rod 37 is inserted for actuating a valve 38 which is provided at the cold side of the bypass conduit. This valve already assumes the temperature of the LT stage. Therefrom, a narrow tubular section 29 extends through a spiral groove 40 in the cooling head to expansion space 39 of the LT stage. Spiral groove 40 improves the heat exchange between the gas flowing in and out, and the cooling head.

Valves 31 and 38 are actuated through an electromagnet 41, against a spring 43. Spring 42 establishes a resilient connection between the two valves, so that both close under a predetermined spring force. Valve rod 37 and poppets 38 and 31 are advantageously made of a plastic, such as teflon.

While specific embodiments of the invention have been described in detail to illustrate the application of the principles of the invention, it will be understood that the invention may be embodied otherwise without departing from such principles.

What is claimed is:

1. A cryopump having a regenerator, comprising at least one housing having a cooling head portion, a displacer in said housing adjacent said cooling head portion and defining with said cooling head portion an expansion space therebetween, at least one regenerator in said housing adjacent said displacer on a side thereof opposite to said cooling head portion, flow means for selectively directing a high pressure gas into said housing and for withdrawing the gas from said housing, and a bypass line connected between said flow means and the expansion space for directing some of the high pressure gas to the expansion space during defrosting.

2. A device according to claim 1, wherein said flow means includes a line connected into said housing adjacent said regenerator for flow up to the expansion space, a bypass line connected to said flow line at its one end and having an opposite end connected into said expansion space and valve means permitting flow from said flow line to said bypass line to said expansion space.

3. A device according to claim 2, including a cross line connected to said gas flow line having one valve for permitting the flow of gas therethrough into said high pressure gas supply line and another valve spaced therefrom for permitting flow of the high pressure gas out of the cryogenerator.

4. A device according to claim 1, wherein said pump is a multi-stage unit including at least one smaller cooling head portion with a smaller displacer and regenerator therein and a larger cooling head portion which is smaller than said smaller cooling head portion having a large displacer and regenerator therein.

5. A device according to claim 1, including a supply line connected from the high pressure gas source to a space adjacent the larger regenerator, a bypass line connected from said supply line to an expansion space between said smaller displacer and said smaller cooling head and a choke valve in said bypass line.

6. A device according to claim 5, wherein said bypass line includes a valve adjacent each end thereof for shutting off said line.

* * * * *